US012709982B2

(12) United States Patent
Dodgson et al.

(10) Patent No.: US 12,709,982 B2
(45) Date of Patent: Aug. 18, 2026

(54) SYSTEM AND METHOD FOR CONTROLLING ROOF SUPPORT

(71) Applicant: Joy Global Underground Mining LLC, Warrendale, PA (US)

(72) Inventors: Keith Dodgson, Burnley (GB); Mark Brocklehurst, Warrington (GB)

(73) Assignee: Joy Global Underground Mining LLC, Warrendale, PA (US)

( * ) Notice: Subject to any disclaimer, the term of this patent is extended or adjusted under 35 U.S.C. 154(b) by 240 days.

(21) Appl. No.: 18/295,704

(22) Filed: Apr. 4, 2023

(65) Prior Publication Data

US 2023/0243260 A1 Aug. 3, 2023

Related U.S. Application Data

(62) Division of application No. 16/581,083, filed on Sep. 24, 2019, now Pat. No. 11,655,711.
(Continued)

(51) Int. Cl.
*E21D 23/00* (2006.01)
*E21D 23/03* (2006.01)
(Continued)

(52) U.S. Cl.
CPC ..... *E21D 23/0004* (2013.01); *E21D 23/03* (2013.01); *E21D 23/12* (2013.01); *E21F 17/18* (2013.01)

(58) Field of Classification Search
CPC ..... E21D 23/0004; E21D 23/03; E21D 23/12; E21D 23/14; E21D 23/142; E21C 27/20;
(Continued)

(56) References Cited

U.S. PATENT DOCUMENTS 3,898,845 A 8/1975 Plevak et al.
3,902,325 A 9/1975 Sigott et al.
(Continued)

FOREIGN PATENT DOCUMENTS

CN 101952548 A 1/2011
DE 3426179 A1 1/1985
(Continued)

OTHER PUBLICATIONS

Australian Examination Report for Application No. 2019346421 dated Aug. 8, 2024, 3 Pages.
(Continued)

*Primary Examiner* — Sean D Andrish
(74) *Attorney, Agent, or Firm* — Husch Blackwell LLP

(57) ABSTRACT

A system for controlling a roof support, including a canopy for engaging a mine surface, includes a sensor configured to generate a signal indicative of a position of an end of the canopy, and a controller. The controller is configured to receive the signal and determine whether a portion of a mining machine will contact a portion of the canopy based on the signal. For example, a method for controlling operation of a roof support includes generating a signal indicative of a position of a canopy of the roof support relative to a mine face and determining that a portion of a mining machine will contact a portion of the canopy based on at least the first signal.

16 Claims, 7 Drawing Sheets

Related U.S. Application Data

(60) Provisional application No. 62/735,586, filed on Sep. 24, 2018.

(51) Int. Cl.
*E21D 23/12* (2006.01)
*E21F 17/18* (2006.01)

(58) Field of Classification Search
CPC ..... E21C 35/24; E21C 35/282; E21C 35/302; E21F 17/18
See application file for complete search history.

(56) References Cited

U.S. PATENT DOCUMENTS

| | | | | |
|---|---|---|---|---|
| 4,048,804 | A | 9/1977 | Elsner et al. | |
| 4,065,929 | A | 1/1978 | Simpson | |
| 4,094,155 | A * | 6/1978 | Blumenthal | E21D 23/04 405/296 |
| 4,197,035 | A | 4/1980 | Siebenhofer et al. | |
| 4,382,722 | A | 5/1983 | Romanowicz et al. | |
| 4,411,558 | A | 10/1983 | Rutherford | |
| 4,474,510 | A | 10/1984 | Bull | |
| 4,480,946 | A | 11/1984 | Kelley | |
| 4,491,441 | A | 1/1985 | Freeman et al. | |
| 4,492,495 | A | 1/1985 | Rutherford et al. | |
| 4,557,635 | A | 12/1985 | Watermann et al. | |
| 4,607,986 | A | 8/1986 | Brown | |
| 4,784,532 | A | 11/1988 | Prescott | |
| 5,163,738 | A * | 11/1992 | Linsingen-Heintzmann | E21C 27/34 299/34.03 |
| 8,297,888 | B2 | 10/2012 | Voss | |
| 8,430,604 | B2 | 4/2013 | Onsori | |
| 8,567,870 | B2 | 10/2013 | Junker et al. | |
| 2010/0119311 | A1 | 5/2010 | Voss | |
| 2011/0006586 | A1 | 1/2011 | Holme | |
| 2011/0097158 | A1 | 4/2011 | Onsori | |
| 2012/0163926 | A1 | 6/2012 | Onsori | |
| 2013/0187436 | A1 | 7/2013 | Wang et al. | |
| 2014/0077580 | A1 | 3/2014 | Holme | |
| 2015/0061350 | A1* | 3/2015 | Paterson | E21C 35/08 299/1.4 |
| 2016/0061036 | A1 | 3/2016 | Siegrist et al. | |
| 2017/0159436 | A1 | 6/2017 | Simpson | |

FOREIGN PATENT DOCUMENTS

| | | | |
|---|---|---|---|
| GB | 2192659 | A | 1/1988 |
| GB | 2254640 | A | 10/1992 |
| GB | 2297348 | A | 7/1996 |
| WO | 2017071001 | A1 | 5/2017 |

OTHER PUBLICATIONS

Chinese Patent Decision of Rejection for Related Application No. 201980075462.0 dated May 5, 2024 (14 pages, including an English summary).

Chinese Patent Third Office Action for Related Application No. 201980075462.0 dated Jan. 18, 2024 (13 pages, including an English summary).

Chinese Patent Second Office Action for Related Application No. 201980075462.0 dated Nov. 8, 2023 (13 pages, including an English summary).

Chinese Patent Office Action for Related Application No. 201980075462.0 dated Feb. 23, 2023 (13 pages, including an English summary).

International Search Report and Written Opinion for Application No. PCT/US19/52726 dated Dec. 16, 2019 (12 pages).

* cited by examiner

SYSTEM AND METHOD FOR CONTROLLING ROOF SUPPORT

CROSS-REFERENCE TO RELATED APPLICATION

This application is a divisional of and claims the benefit of prior-filed, co-pending U.S. patent application Ser. No. 16/581,083, filed Sep. 24, 2019, which claims priority to U.S. Provisional Patent Application No. 62/735,586, filed Sep. 24, 2018, the entire contents of each of which are incorporated by reference.

TECHNICAL FIELD

The present disclosure relates to roof supports, e.g., for an underground mine, particularly a roof support including extendable links.

BACKGROUND

Longwall mining systems include a mining machine, such as a longwall shearer, and roof supports. The roof supports include canopies include forward ends positioned proximate the mine face, but spaced apart by a tip-to-face distance or clearance distance. Unsupported space between the canopy and the face is important for discrepancies encountered as a shearer cuts the mining surface.

SUMMARY

In one aspect, a roof support includes a base, a canopy for engaging a mine surface, a shield coupled to the canopy, and a link coupled between the base and the shield. The canopy is supported relative to the base and includes an end configured to be spaced apart from a mine face by a distance. The link is movable between a first position and a second position, and movement of the link between the first position and the second position causing the distance to change.

In some aspects, the first position is a retracted position and the second position is an extended position.

In some aspects, the link is a telescoping box link including a first portion proximate a first end, a second portion slidably coupled to the first portion, and a linear actuator for moving the second portion relative to the first portion.

In some aspects, the roof support further includes a sensor configured to detect a position of the canopy relative to the mine face.

In some aspects, the link is a first link, and the roof support further includes a second link coupled between the base and the shield, the first link configured to be positioned between the second link and the mine face.

In some aspects, the roof support further includes a jack supporting the canopy relative to the base, the jack being extendable and retractable relative to the base.

In some aspects, the link is one of a pair of links coupled between the base and the shield, the pair of links being movable between a first position and a second position, and movement of the pair of links between the first position and the second position causes the distance to change.

In another independent aspect, a system is provided for controlling a roof support including a canopy for engaging a mine surface. The system includes a sensor configured to generate a signal indicative of a position of an end of the canopy, and a controller. The controller is configured to receive the signal indicative of the position of the canopy, and determine whether a portion of a mining machine will contact a portion of the canopy based on the signal.

In some aspects, when the controller determines that contact will occur, the controller is further configured to perform at least one of the following: operate an actuator to modify the position of the canopy, and generate an alert to an operator.

In some aspects, the signal is a first signal, and the controller is configured to receive a second signal indicative of at least one of a position of the mining machine and a path of the mining machine, the controller comparing the first signal to the second signal.

In some aspects, the controller determines that contact will occur if the controller determines that the portion of the mining machine will pass less than a predetermined minimum distance relative to the canopy.

In some aspects, the actuator is operable to extend and retract a link of the roof support, extension and retraction of the actuator causing the canopy to move.

In some aspects, the link is coupled between a base of the roof support and a shield coupled to the canopy.

In yet another independent aspect, a method for controlling operation of a roof support includes: generating a first signal indicative of a position of a canopy of the roof support; and determining whether a portion of a mining machine will contact a portion of the canopy based on at least the first signal.

In some aspects, the method further includes generating a second signal indicative of at least one of a position of the portion of the mining machine and a path of the portion of the mining machine, and determining whether the portion of the mining machine will contact the portion of the canopy is based on the first signal and the second signal.

In some aspects, the method further includes, when the controller determines that contact will occur, operating an actuator to modify a position of the canopy.

In some aspects, operating the actuator includes changing a length of a telescopic link, thereby causing the canopy to move away from a mine face.

In some aspects, the method further includes, when the controller determines that contact will occur, generating an alert to notify an operator.

In some aspects, determining whether the portion of the mining machine is likely to contact the portion of the canopy includes determining whether the portion of the mining machine will pass within a minimum predetermined distance of the canopy.

Other independent aspects of the disclosure will become apparent by consideration of the detailed description, claims, and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including," "comprising," or "having" and variations thereof herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings. Also, electronic communications and notifications may be performed using any known means including direct connections, wireless connections, etc.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized. For example, "controllers" described in the specification may include one or more electronic processors or processing units, one or more computer-readable medium modules, one or more input/output interfaces, and various connections (for example, a system bus) connecting the components.

DETAILED DESCRIPTION

The disclosure generally relates to a longwall mining system including a roof support having extendable links. In some embodiments, the links may be telescoping, adjusting the distance between a canopy of the roof support and a mine face. In some embodiments, the extension of the links may be controlled to modify a position of a canopy to avoid a potential collision.

Figure 1:
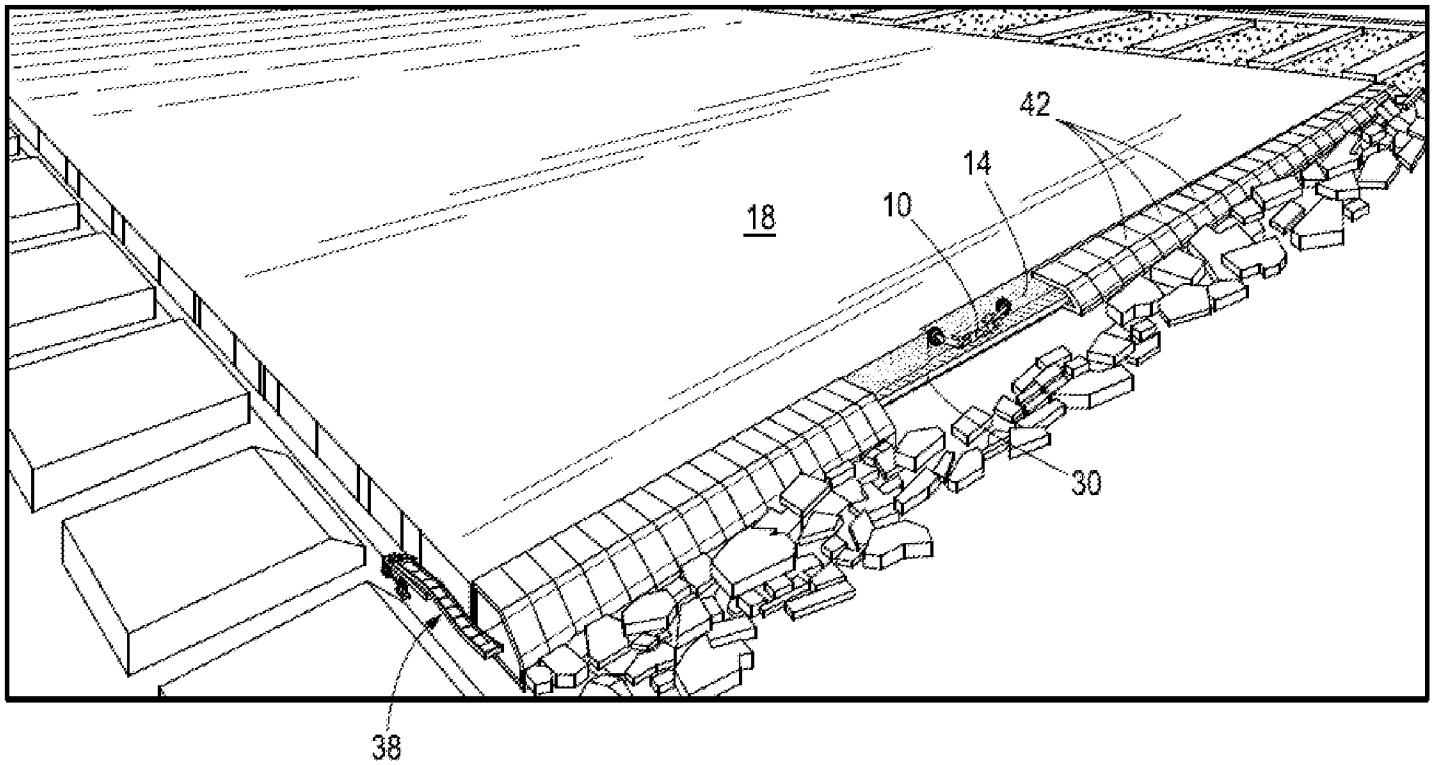
FIG. 1 is a perspective view of a mining system.
Figure 2:
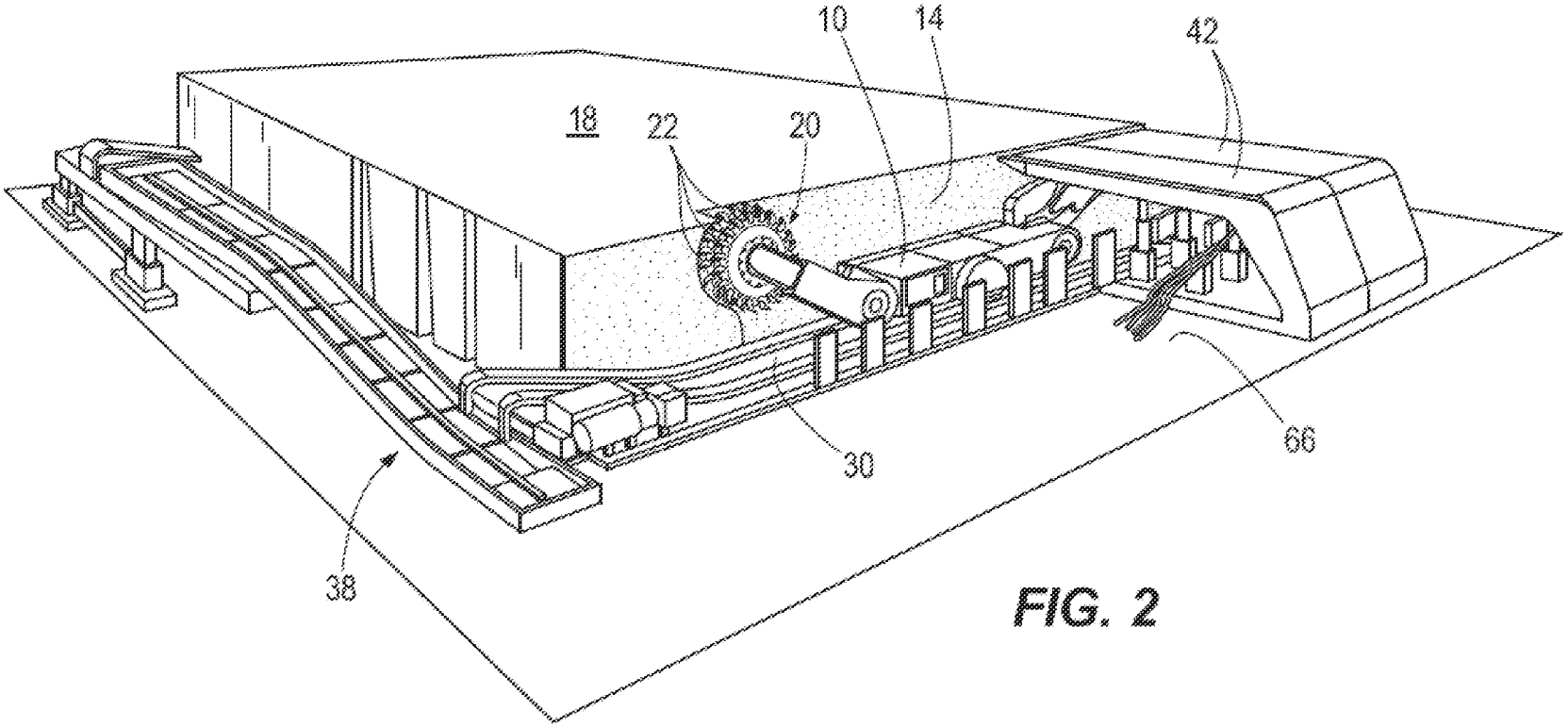
FIG. 2 is an enlarged perspective view of the mining system of FIG. 1.

FIGS. 1 and 2 illustrate a longwall mining operation. A mining machine 10 excavates material from a mine face 14 of a mineral seam 18, and progresses through the seam 18 as material is removed. In the illustrated embodiment, the mining operation is "retreating" such that the shearer 10 progresses through the seam 18 toward a mine exit (not shown). In other embodiments, the operation may be "advancing" such that the shearer 10 progresses through the seam 18 away from the mine exit.

In the illustrated embodiment, the mining machine 10 is a conventional longwall shearer that moves or trams along the mine face 14. As shown in FIG. 2, the mining machine 10 includes one or more cutting heads, such as rotating cutting drums 20, including cutting bits 22 that engage the mine face 14 and cut material from the mine face 14. Each drum 20 may include vanes (not shown) for carrying the cut material from the face 14 toward a rear end of the drum 20, where the material is deposited onto a face conveyor 30. The face conveyor 30 moves the material toward an edge of the mine face 14, where the cut material may be transferred to a main gate conveyor via a beam stage loader 38 (FIG. 2). In some embodiments, the face conveyor 30 is a chain conveyor including flight bars coupled between multiple chain strands, and the conveyor drives material along a pan formed as interconnected sections. Other aspects of the structure and operation of the machine 10 and the conveyor 30 will be readily understood by a person of ordinary skill in the art.

As shown in FIGS. 1 and 2, powered roof supports 42 are aligned in a row along the length of the mine face 14 to provide protection to operators as well as the components of the mining operation (e.g., the mining machine 10, the face conveyor 30). For illustration purposes, some of the roof supports 42 are removed in FIGS. 1 and 2.

Figure 3:
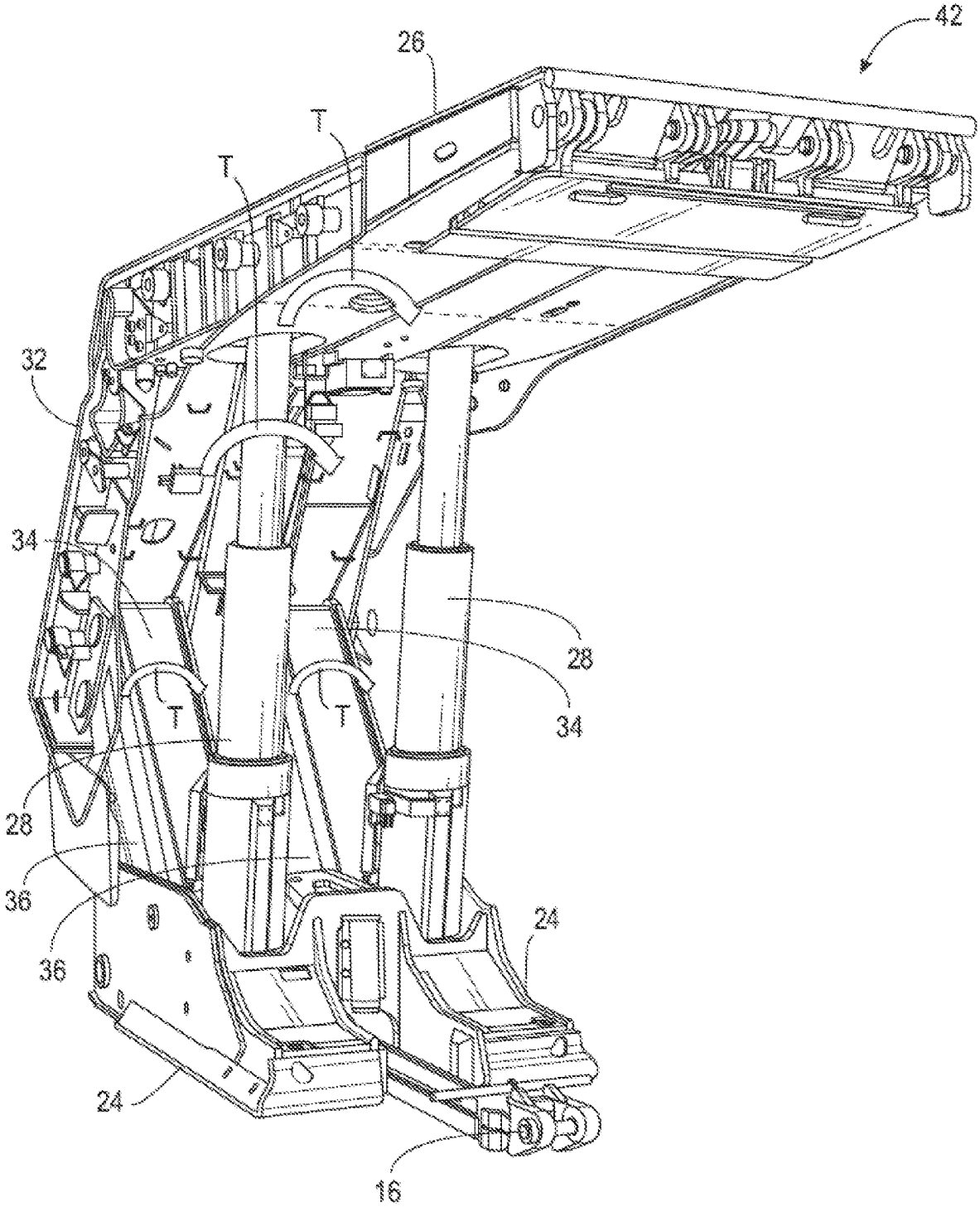
FIG. 3 is a perspective view of a roof support.

Referring now to FIG. 3, each roof support 42 includes a base 24, a canopy 26, and actuators, or jacks, 28 extending between the base 24 and the canopy 26. The base 24 is positioned on a support surface or floor 66 (FIG. 2) and is coupled to the face conveyor 30 by a linear actuator 16 (e.g., a hydraulic cylinder or ram). As the mining operation progresses, the roof supports 42 and face conveyor 30 may advance to maintain a desired position with respect to the mine face 14 (FIG. 2). In some embodiments, each of the sections of the conveyor pan is coupled to the base 24 of an associated one of the roof supports 42. The linear actuator 16 may extend to advance the associated section of the conveyor pan.

Figure 4A:
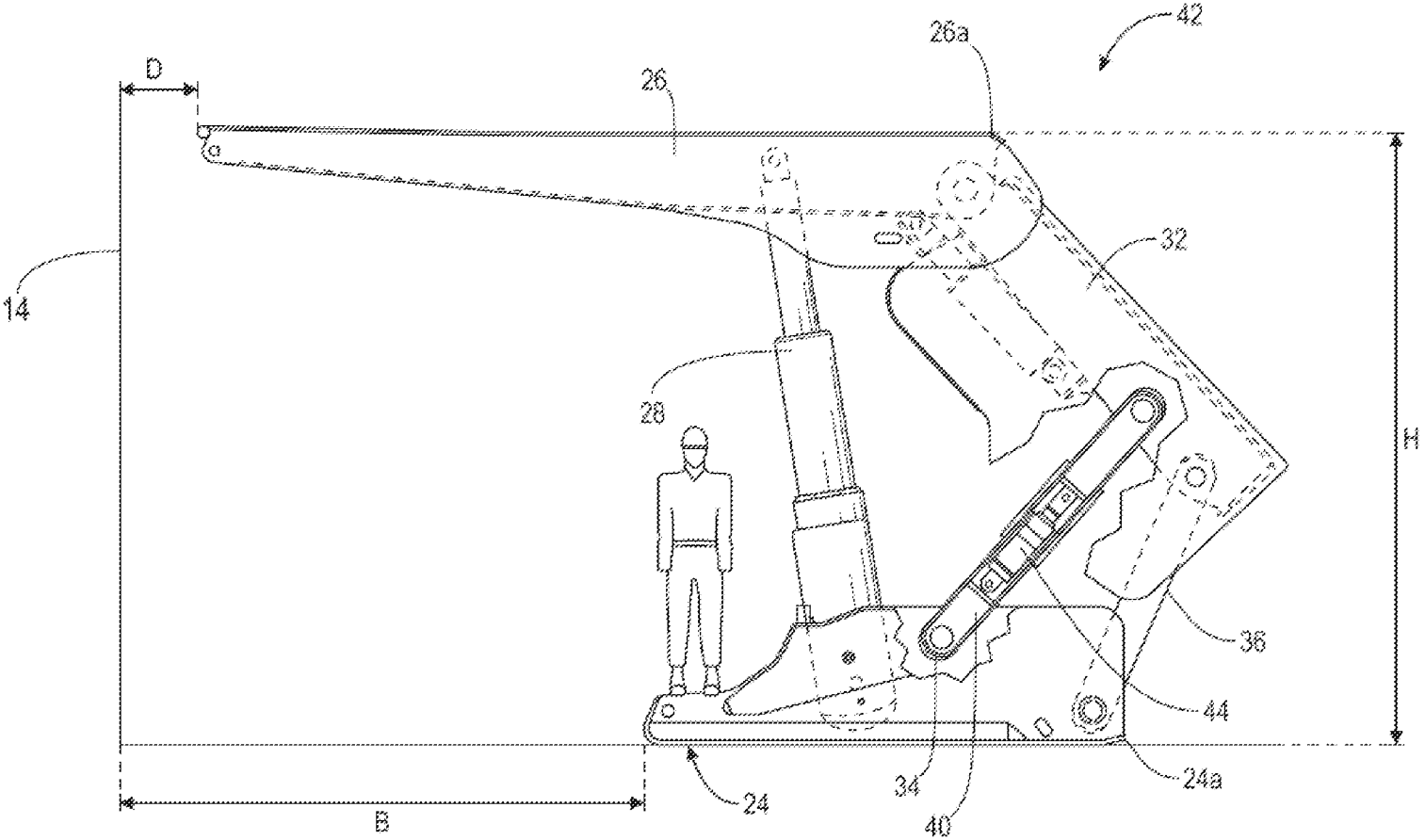
FIG. 4A is a side view of a roof support with a canopy in a first position.
Figure 4B:
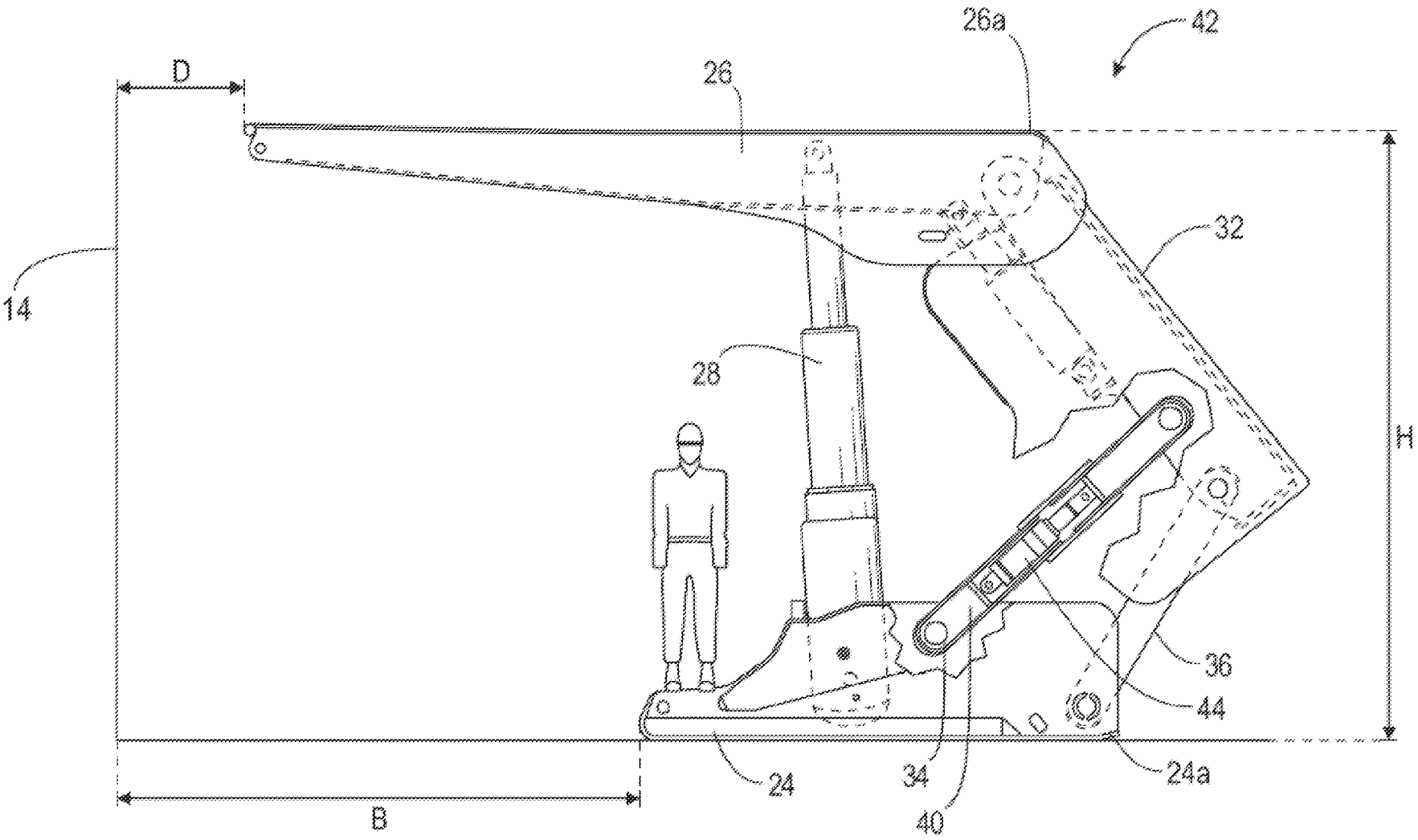
FIG. 4B is a side view of the roof support of FIG. 4A with the canopy in a second position.

The canopy 26 is positioned adjacent a hanging wall or mine roof (not shown). Each roof support 42 includes a shield 32 coupled between a rear end 24*a* (FIG. 4A) of the base 24 and a rear end 26*a* of the canopy 26. The shield 32 and the base 24 are pivotably coupled to one another by multiple links. Referring to FIGS. 3, 4A, and 4B, first links or upper links or forward links 34 are coupled between the shield 32 and the base 24, and second links or lower links or rearward links 36 are coupled between the shield 32 and the base 24. As best shown in FIG. 3, the forward links 34 include a pair of links spaced apart from one another along the width of the roof support 42. The forward links 34 are positioned between the rearward links 36 and the mine mine face 14. The forward links 34 and rearward links 36 (sometimes referred to as lemniscate links) provide stability for the roof support 42 in the face-to-goaf direction and facilitate transmission of torque loads T (FIG. 3) from the canopy 26 and shield 32 to the base 24. Torque loads T may be caused, for example, by uneven roof surfaces.

As shown in FIGS. 4A and 4B, the forward links 34 are extendable to permit adjustment of the position of the canopy 26 by adjusting a tip-to-face clearance D. In the illustrated embodiment, each of the forward links 34 includes a box link 40 with telescoping portions, and a linear fluid actuator 44 (e.g., a hydraulic cylinder or ram) is positioned inside the telescoping portions and is operable to extend and retract the ends of the box link 40. The box links 40 facilitate the transmission of the torque load(s) T to the base 24, while also protecting the actuators 44. In the illustrated embodiment, the default or normal operating position for the forward links 34 is a retracted position. Since the forward links 34 are typically subjected to compressive loads, the forward links 34 therefore perform similar to conventional links while fully retracted.

Figure 5:
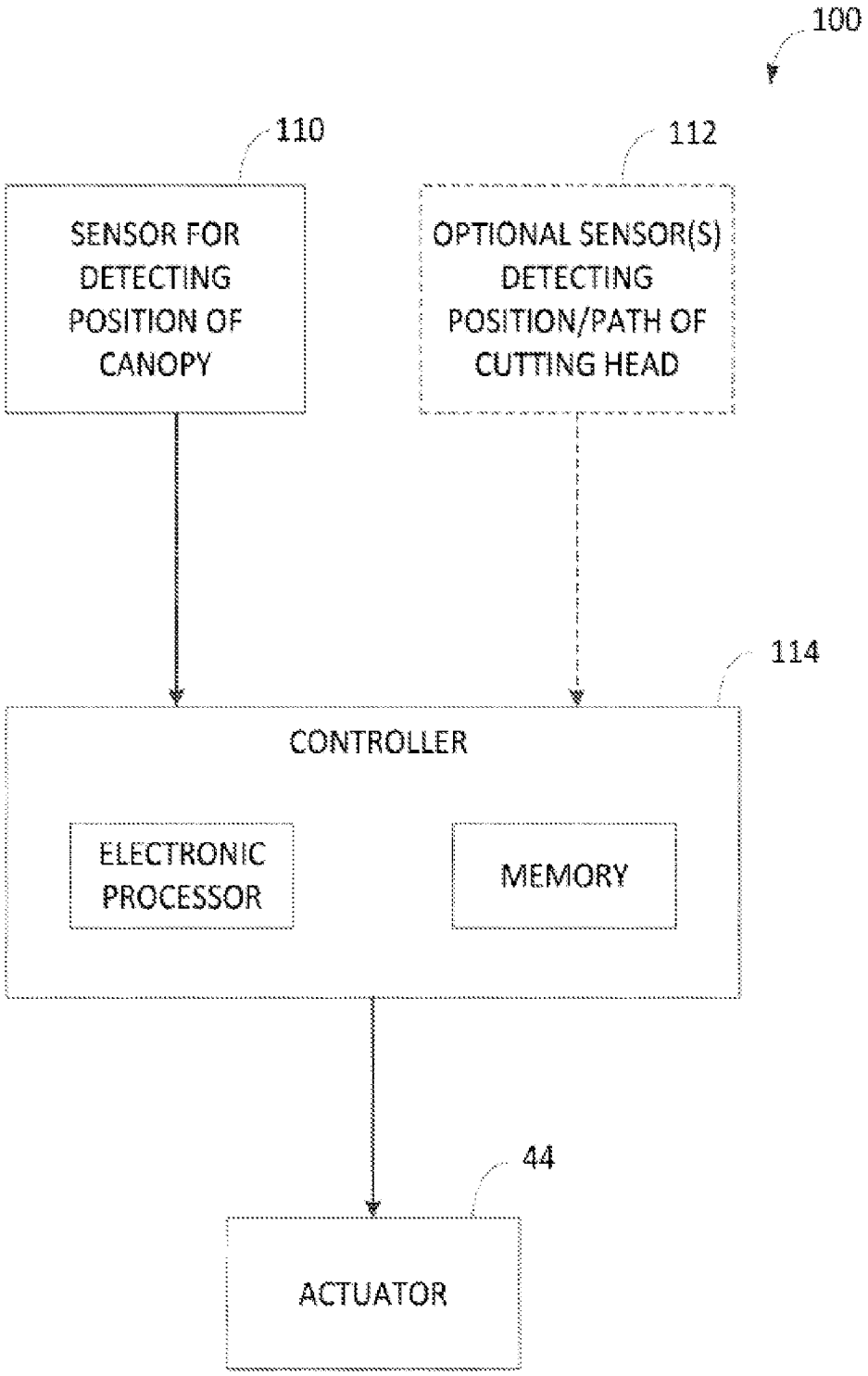
FIG. 5 is a diagram of a system for controlling operation of a roof support.

As shown in FIG. 5, in some embodiments the system 100 includes one or more sensors 110 for detecting a position of the canopy 26 (FIG. 4A). The sensor(s) 110 may include, for example, a transducer positioned within the actuators 44.

The sensor 110 is in communication with a controller 114. In some embodiments, the controller 114 also has access to information regarding the geometry of at least a portion of the roof support 42 (e.g., the canopy 26) and at least a portion of the mining machine 10 (e.g., the cutting heads 20). For example, this information may be provided by one or more sensors, or may be stored in an electronic memory unit that is in communication with an electronic processor. Also, in some embodiments, additional sensors 112 may detect a path and/or a position of the cutting heads 20 of the mining machine 10.

In some embodiments, the sensors may provide positioning data to the controller 114 in order verify and validate the presence of convergence or developing cavities within the mine face 14. In addition, sensors in the actuators 44 can provide additional position data and assist in identifying potential convergence or developing cavities.

Figure 6:
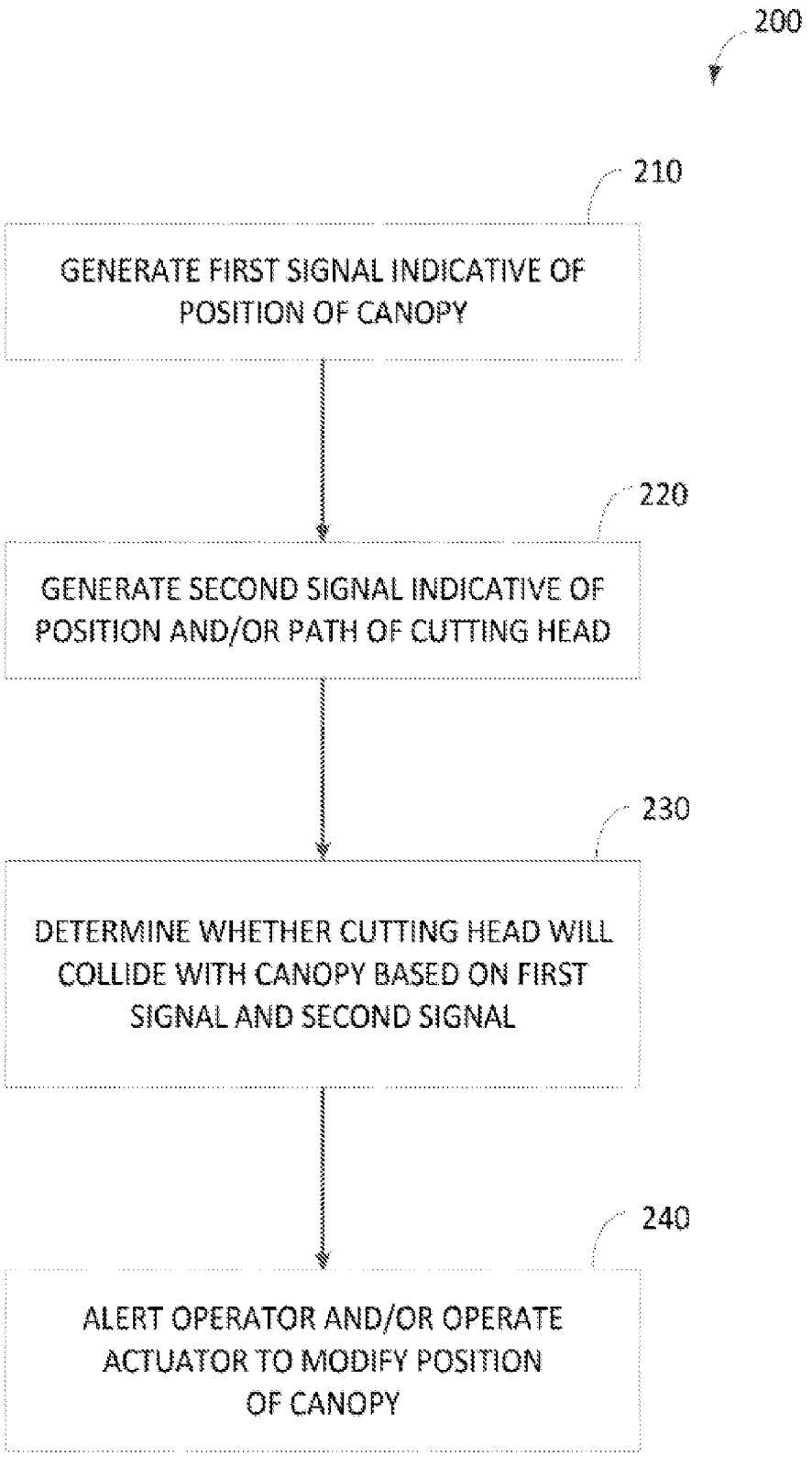
FIG. 6 is a flowchart of a method for controlling operation of a roof support.

The controller 114 determines whether the mining machine 10 will contact or strike a portion of the canopy 26 based on the detected position information. In some embodiments, the controller 114 can operate the actuators 44 to move the forward links 40 and modify the position of the canopy 26 to avoid collision. In some embodiments, the control system may alert an operator of a potential collision between the mining machine 10 and the canopy 26. FIG. 6 illustrates a control method 200 according to one example. In the illustrated embodiment, The method includes generating (for example, with the sensor 110) a first signal indicative of a position of the canopy 26 at 210, and generating (for example, with another sensor or from electronic memory) a second signal indicative of a position and/or a path of the cutting head of the mining machine 10 at 220. The controller 114 is configured to determine at 230 whether the cutting head will collide with the canopy 26 based on the first signal and the second signal. In some embodiments, this determination may include determining whether the cutting head 20 will pass within a predetermined minimum distance relative to the canopy 26. At 240, when the controller 114 determines that a collision will occur, the controller 114 can operate the actuators 44 to modify the position of the canopy 26 and/or alert an operator to modify the canopy position.

Referring against to FIG. 4A, the roof support 42 is positioned proximate a face 14 with the forward links 34 in a retracted position. A distance between a forward end of the canopy 26 and the mine face 14 defines the tip-to-face clearance D. An operator can adjust the tip-to-face clearance D by adjusting the length of the forward links 34. The ability to increase the clearance D can improve the versatility of the roof support 42 and avoid the need to implement complex tip designs for the forward edge of the canopy 26.

For example, if additional space is required between the canopy 26 and the face 14 (e.g., in order to permit a shearer drum to perform a cut along the top of the face), the linear actuators 44 may be operated to extend the forward links 34. As shown in FIG. 4B, the extension of the forward links 34 pivots the shield 32 rearwardly about the rear link 36, moving the canopy 26 away from the face 14. In the illustrated embodiment, when the forward links 34 are in the extended positions, the tip-to-face clearance D is increased. Increasing the clearance D can permit a shearer to pass the canopy 26, after which the forward links 34 can be actuated to move the canopy 26 back to the extended position. When a sensor detects a potential collision, an operator or an automatic controller activates the actuators 44, moving the forward links 34 to pivot the shield 32 and provide clearance between the shearer 10 and the canopy 26.

The extendable forward links 34 support the canopy 26 while also permitting the position of the canopy to be adjusted as necessary. As shown in FIGS. 4A and 4B, in some embodiments, the forward link 34 can be extended or retracted while substantially maintaining a distance B between the base 24 and the mine face 14, and maintaining a height H of the support surface of the canopy 26.

In some conventional systems, potential collisions between the roof support 42 and the shearer 10 are avoided by halting the shearer 10 and lowering the drums 20 and/or moving the roof supports 42 away from the face, into a goaf. Lowering the drums 20 may lead to developing steps in the roof and closing the face, making advancement more difficult, and moving the entire roof support 42 away from the face can be cumbersome. In contrast, a control system of the roof support 42 can anticipate and automatically prevent a collision. By increasing the tip-to-face clearance D, the user may remove a tip of the canopy out of the collision course without lowering the drum 20.

Also, in some circumstances (e.g., in the presence of poor roof conditions), an operator may perform a second or intermediate advance of the roof support 42 (sometimes referred to as "double chocking"), advancing the roof support by a shorter incremental distance to avoid advancing the roof support too far such that it blocks the path of the shearer. Such incremental advances require moving the roof supports significantly more times and lead to longer cycle times. In contrast, the ability to increase the tip-to-face clearance D permits an operator (at least in some situations) to operate a normal first advance and second advance without the need for an incremental advance, thereby decreasing cycle times and increasing the overall efficiency of the mining operation.

Although various aspects have been described in detail with reference to certain embodiments, variations and modifications exist within the scope and spirit of one or more independent aspects as described. Various features and advantages are set forth in the following claims.

What is claimed is:

1. A system for controlling a roof support including a base, a canopy for engaging a mine surface, and a shield coupled to the canopy and positioned between a rear end of the base and the canopy, the system comprising:

an actuator operable to extend and retract a link coupled between the base and the shield, wherein extension and retraction of the link generates translational motion of the canopy relative to a mine face while maintaining a height of the canopy relative to the base and a distance between the base and the mine face;

a sensor configured to generate a signal indicative of a position of an end of the canopy relative to the mine face; and a controller configured to:

receive the signal indicative of the position of the canopy relative to the mine face, determine that a portion of a mining machine will contact a portion of the canopy based on the signal, and operate the actuator to adjust the position of the canopy relative to the mine face while maintaining the height of the canopy and the distance between the base and the mine face.

2. The system of claim 1, wherein the controller is further configured to generate an alert to an operator.

3. The system of claim 1, wherein the signal is a first signal, the controller being configured to receive a second signal indicative of at least one of a position of the mining machine and a path of the mining machine, the controller comparing the first signal to the second signal.

4. The system of claim 1, wherein the controller determines that contact will occur if the controller determines that the portion of the mining machine will be positioned less than a predetermined minimum distance relative to the canopy.

5. A method for controlling operation of a roof support including a base, a canopy for engaging a mine surface, and a shield coupled to the canopy and positioned between a rear end of the base and the canopy, the method comprising:

generating a signal indicative of a position of the canopy of the roof support relative to a mine face;

determining that a portion of a mining machine will contact a portion of the canopy based on at least the signal; and operating an actuator to change a length of a telescopic link coupled between the base and the shield, thereby generating translational motion of the canopy relative to the mine face while maintaining a height of the canopy relative to the base and a distance between the base and the mine face in response to determining that the portion of the mining machine will contact the portion of the canopy.

6. The method of claim 5, wherein the signal is a first signal, the method further comprising generating a second signal indicative of at least one of a position of the portion of the mining machine and a path of the portion of the mining machine, wherein determining that the portion of the mining machine will contact the portion of the canopy is based on the first signal and the second signal.

7. The method of claim 5, further comprising generating an alert to notify an operator in response to determining that the portion of the mining machine will contact the portion of the canopy.

8. The method of claim 5, wherein determining that the portion of the mining machine will contact the portion of the canopy includes determining that the portion of the mining machine will pass within a minimum predetermined distance of the canopy.

9. A roof support for a mining machine, comprising:

a base;

a canopy configured to engage a mine roof, an end of the canopy positioned proximate to a mine face, an upper surface of the canopy spaced apart from the base by a height;

a shield coupled to the canopy, the shield positioned between a rear end of the base and the canopy;

at least one jack coupled between the base and the canopy; and at least one actuator coupled between the base and the shield, operation of the at least one actuator adjusting a position of the canopy relative to the mine face while maintaining the height of the upper surface of the canopy relative to the base and a distance between the base and the mine face.

10. The roof support of claim 9, further comprising an extendable link coupled between the base and the shield.

11. The roof support of claim 10, wherein operation of the at least one actuator changes a length of the extendable link.

12. The roof support of claim 9, further comprising:

at least one sensor configured to generate a signal indicative of a position of the canopy relative to the mine face; and a controller in communication with the at least one sensor, the controller configured to determine that a portion of the mining machine will contact a portion of the canopy based at least on the signal.

13. The roof support of claim 12, wherein the controller is configured to operate the at least one actuator in response to determining that the portion of the mining machine will contact the portion of the canopy.

14. The roof support of claim 13, wherein the signal is a first signal, the controller being configured to receive a second signal indicative of at least one of a position of the mining machine and a path of the mining machine and to compare the first signal and the second signal.

15. The roof support of claim 12, wherein the controller determines that the portion of the mining machine will contact the portion of the canopy by determining that the portion of the mining machine will pass within a minimum predetermined distance of the canopy.

16. The roof support of claim 9, wherein the at least one actuator is operable to extend and retract a link of the roof support, extension and retraction of the link causing the canopy to move in a translational manner relative to the mine face while maintaining the height of the upper surface of the canopy relative to the base and the distance between the base and the mine face.

* * * * *